United States Patent [19]

Hawbaker et al.

[11] Patent Number: 4,899,841

[45] Date of Patent: Feb. 13, 1990

[54] LEVELING ASSEMBLY FOR A WORK VEHICLE

[75] Inventors: Jerry B. Hawbaker; Dave Kleinschrodt; Ryland H. Eichhorst, all of Dubuque, Iowa

[73] Assignee: Deere & Company, Moline, Ill.

[21] Appl. No.: 296,455

[22] Filed: Jan. 12, 1989

[51] Int. Cl.[4] ..... B62D 55/08

[52] U.S. Cl. ..... 180/9.52; 180/9.1; 144/3 D; 414/687

[58] Field of Search ..... 280/840, 6.11, 6.12; 180/41, 9.52, 9.5, 9.1; 414/687; 144/3 D, 34 R

[56] References Cited

U.S. PATENT DOCUMENTS

| | | | |
|---|---|---|---|
| 4,324,304 | 4/1982 | Hashimoto et al. | 180/9.52 |
| 4,326,571 | 4/1982 | Crawford | 144/34 E |
| 4,650,017 | 3/1987 | Pelletier et al. | 180/9.1 |
| 4,679,803 | 7/1987 | Biller et al. | 180/41 |
| 4,763,742 | 8/1988 | Langford | 180/41 |

*Primary Examiner*—Charles A. Marmor
*Assistant Examiner*—Donn McGiehan

[57] ABSTRACT

The present invention is directed to a leveling assembly for a work vehicle. The leveling assembly comprises upper and lower plates that are pivotally connected to one another about a horizontal axis. Two trunnion mounted hydraulic cylinders are mounted to the plates for changing the relative angular position of the plates to one another. The upper plate is mounted to the upper structure of the work vehicle, whereas the lower plate is mounted to the undercarriage of the work vehicle. A portion of each trunnion mounted cylinder extends downwardly into the undercarriage of the work vehicle.

7 Claims, 2 Drawing Sheets

FIG. 1
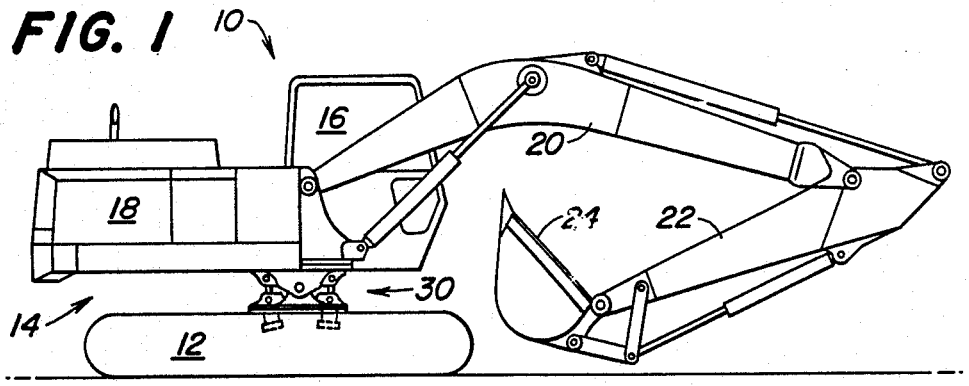
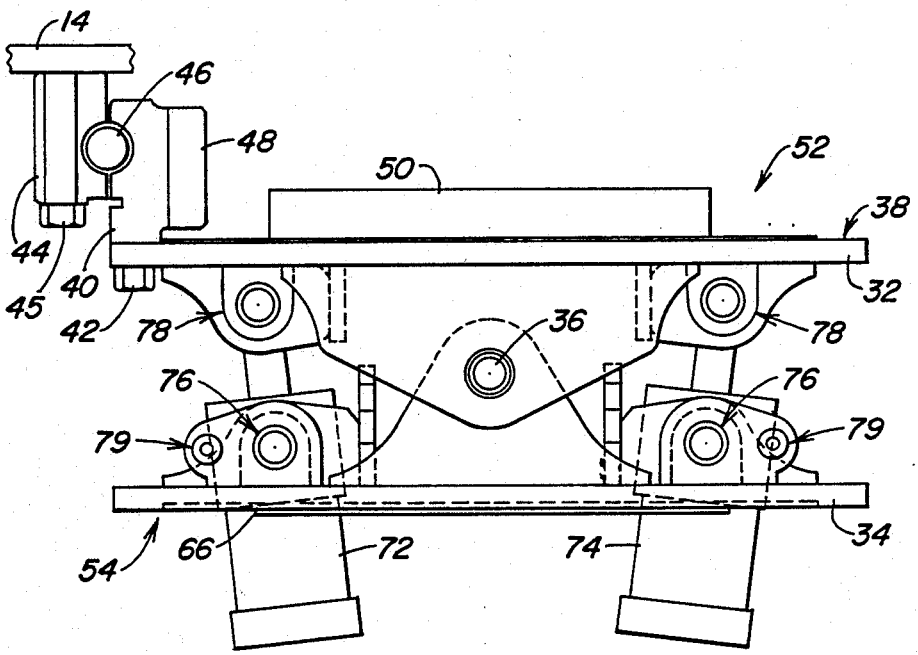
FIG. 2

FIG. 3
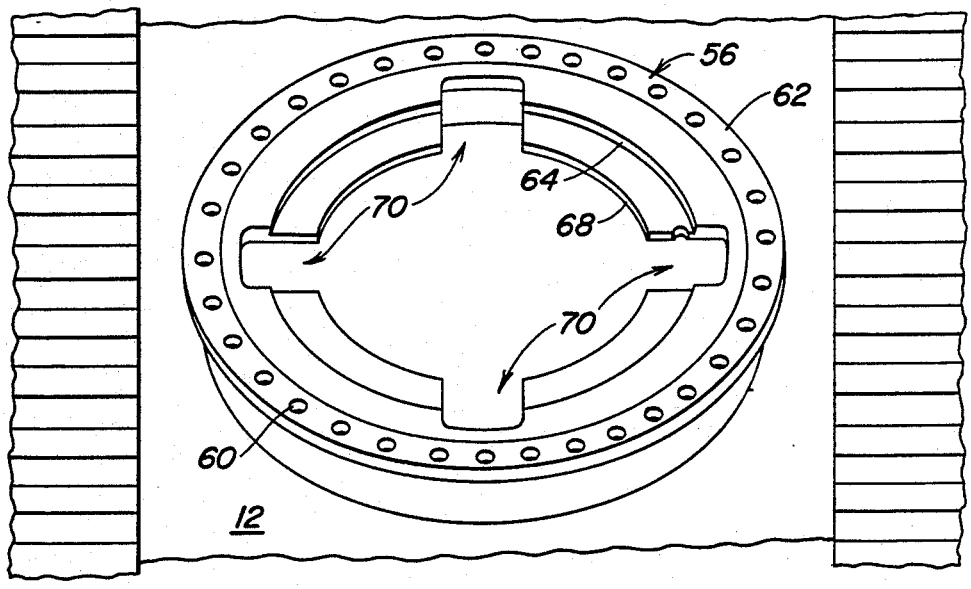
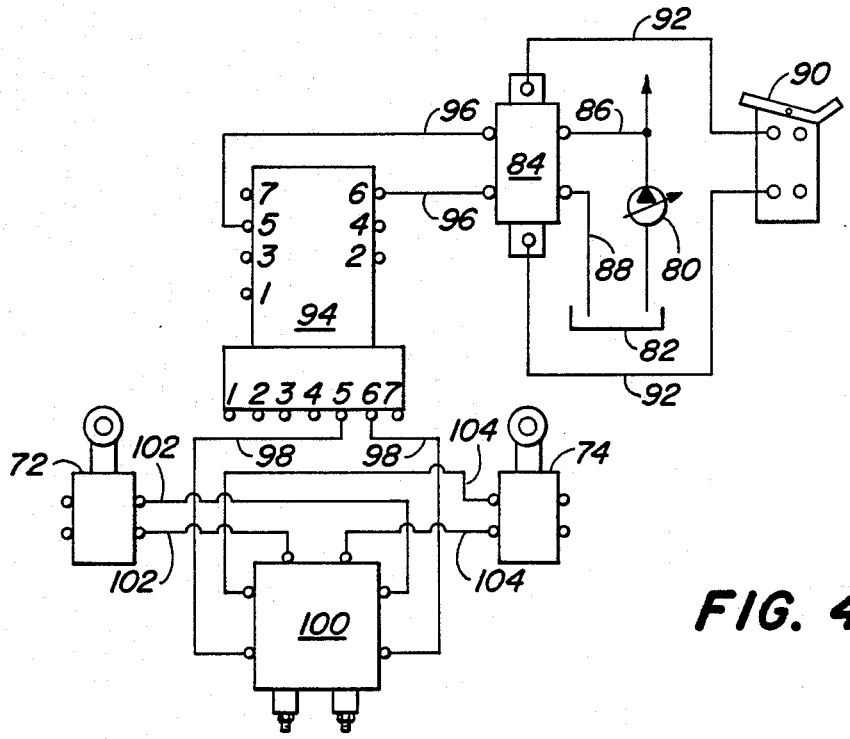
FIG. 4

LEVELING ASSEMBLY FOR A WORK VEHICLE

BACKGROUND OF THE INVENTION

1. Field of the Invention

The invention is directed to a leveling assembly for a work vehicle having trunnion mounted hydraulic cylinders.

2. Description of the Prior Art

Work vehicles such as excavators and feller bunchers maybe operated on very uneven terrain. With conventional excavators and feller bunchers, the upper structure of the machine including the operator's cab follows the undercarriage and may provide a tilted work platform. Hydraulic leveling systems are known which change the angular relationship of the upper structure relative to the undercarriage to provide a level work platform. Typically these leveling systems use hydraulic cylinders to pivot the upper structure about a pivot point located between the upper structure and the undercarriage. Work vehicles having leveling assemblies are disclosed in U.S. Pat. Nos. 4,324,304, 4,326,571 and 4,650,017.

SUMMARY

It is an object of the present invention to provide a leveling assembly that is more readily retrofitted into existing work vehicles. It is a feature of the present leveling assembly that it can be mounted between the upper structure and undercarriage without extensive modification of these units.

The invention comprises upper and lower mounting plates that are pivotally interconnected by a pivot assembly defining a pivot axis. Two double acting hydraulic cylinders are operatively positioned between the two mounting plates for changing the relative angular position of the plates about the pivot axis. The upper mounting plate is adapted to mount to the upper structure of the work vehicle, whereas the lower mounting plate is adapted to mount to the undercarriage of the vehicle. The two hydraulic cylinders are provided with trunnion mounting assemblies for mounting the hydraulic cylinders to the lower plate. The upper structure is provided with a rotate mechanism so that it can be rotated about a vertical axis relative to the leveling assembly and undercarriage. The hydraulic cylinders are arranged on opposite sides of the vertical axis and are canted outwardly therefrom.

BRIEF DESCRIPTION OF THE DRAWINGS

FIG. 1 is a side view of an excavator having the leveling assembly of the present invention.

FIG. 2 is a side view of the leveling assembly of the present invention.

FIG. 3 is a perspective view of the modified undercarriage for receiving the leveling assembly of the present invention.

FIG. 4 is a diagram of the hydraulic circuitry used with the leveling assembly of the present invention.

DETAILED DESCRIPTION

FIG. 1 illustrates excavator work vehicle 10 having undercarriage 12 and upper structure 14. The undercarriage is a crawler undercarriage having tracks that are used for supporting and propelling the vehicle. The upper structure is located above the undercarriage and is provided with operator's cab 16 and housing 18. The operator's cab is provided with controls for controlling the movement of the vehicle and manipulation of the working elements of the vehicle. Housing 18 houses an internal combustion engine for driving hydraulic pumps which supply hydraulic fluid for propelling the vehicle and manipulating the working elements. The working elements comprise boom 20, arm 22 and bucket 24. These working elements are manipulated by hydraulic cylinders that are supplied hydraulic fluid from the engine driven pumps, the flow of which is controlled by the operator from operator's cab 16.

Leveling assembly 30 is sandwiched between the upper structure and the undercarriage. The assembly comprises upper plate 32 and lower plate 34 which are pivotally interconnected by pivot pin 36. Pivot pin 36 defines a pivot axis. The plates are manipulated with respect to one another by double acting hydraulic cylinders 72 and 74.

The upper plate is provided with a machined lip 38 to which is secured to first flange 40 by bolts 42. Flange 40 forms part of the rotate mechanism. The rotate mechanism further comprises second flange 44 which is secured to the underside of the upper structure by bolts 45. The two flanges are free to rotate with respect to one another by ball bearings 46. The first flange is provided with inwardly facing teeth 48 that engage a pinion gear of a hydraulic motor for rotating the upper structure relative to the undercarriage.

The upper plate is also provided with grease dam 50. Top surface 52 of the upper plate mimics the upper surface of a conventional undercarriage. As such the rotate mechanism of a conventional upper structure can be readily mounted to the upper plate facilitating manufacturing and retrofitting existing machines with the leveling assembly.

The lower plate is provided with lower mounting surface 54 that conforms to upper surface 56 of the undercarriage. The lower plate is mounted to the undercarriage by bolts that engage existing apertures 60 in the undercarriage. As illustrated in FIG. 3, upper surface 56 of the undercarriage is provided with circular rim 62 in which apertures 60 are located. Rim 62 in a conventional excavator is bolted to first flange 40 of the rotate mechanism. A circular depression having edge 64 is formed in upper surface 56. Edge 64 conforms to rim 66 formed on the lower mounting surface of the lower plate.

In preparing an undercarriage to receive the leveling assembly, a grease dam (similar to grease dam 50) normally present on the top surface of a conventional undercarriage must be cut, out forming circular edge 68. In addition, notches 70 must be cut in the upper surface to accommodate the hydraulic cylinders. It should be noted that the opposite notches define the potential pivot axes. Pivot pin 36 extends between the two hydraulic cylinders, therefore, defining the location of the hydraulic cylinders defines the location of the pivot axis.

Four notches were cut in the undercarriage illustrated in FIG. 3, thereby defining longitudinal and lateral pivot axes relative to the undercarriage. In mounting the leveling apparatus the operator must select the desired pivot axis. If the operator wishes to change the pivot axis, the leveling assembly would have to be lifted from the undercarriage and rotated 90 degrees and remounted to the undercarriage.

The angular position of the two plates relative to one another is controlled by hydraulic cylinders 72 and 74.

The hydraulic cylinders are mounted to the lower plate by a trunnion mounting assemblies 76. The trunnion mounted hydraulic cylinders provide a compact leveling assembly facilitating it being retrofitted into an existing work vehicle. A lower portion of the hydraulic cylinders extends downwardly into the undercarriage. The hydraulic cylinders are mounted to the upper plate by pivot connections 78. Pin locking connection 79 prevents the pin in pivot connection 78 from rotating by trapping an arm extending from the pin.

As illustrated in FIG. 4, hydraulic fluid from pump 80 is directed from sump 82 to leveling assembly control valve 84 through supply line 86. Valve 84 is a four-way three-position valve that is also connected to sump through sump return line 88. The positioning of valve 84 is controlled by foot pedal 90 through communication lines 92. The communication lines may comprise hydraulic pilot control lines, electrical control lines, or mechanical linkages.

The hydraulic fluid is directed to inlet ports 5 and 6 of hydraulic rotary manifold 94 by supply/return lines 96. The hydraulic fluid flows from rotary manifold through outlet ports 5 and 6 through supply/return lines 98 to counter-balance valve 100. The counter-balance valve is hydraulically coupled to double acting hydraulic cylinders 72 and 74 by supply return lines 102 and 104, respectively.

The rotary manifold is a seven port manifold with ports 1–4 and 7 being used for supplying hydraulic fluid to the hydraulic propel motors which drive the tracks. In retrofitting the leveling assembly into an existing excavator it maybe necessary to replace a five port manifold with a seven port manifold to provide the extra hydraulic passages for the leveling cylinders.

In response to an operator's command on foot pedal 90, valve 84 is shifted, directing hydraulic fluid from pump 80 to the double acting cylinders. In this way the operator can easily manipulate the angular position of the upper structure relative to the undercarriage for a variety of slope conditions.

The present leveling assembly provides an easy to use leveling assembly that can be easily retrofitted into a work vehicle. Therefore, the invention should not be limited to the above described embodiment, but should be limited solely to the claims that follow.

We claim:

1. A work vehicle for performing a work operation, the vehicle comprising:

an undercarriage for supporting and propelling the vehicle;

an upper structure located above the undercarriage and having an operator's cab from which the vehicle is operated;

a leveling assembly located between the undercarriage and the upper structure, the leveling assembly comprising an upper plate and a lower plate that are pivotally interconnected by a pivot assembly, the leveling assembly is also provided with to hydraulic cylinders operatively positioned between the plates for changing the relative angular position of the plates about the pivot axis, the two hydraulic cylinders are each provided with a trunnion mounting assembly, the trunnion mounting assembly is mounted to the lower plate and a portion of each hydraulic cylinder extends downwardly into the undercarriage of the work vehicle, the upper plate is mounted to the upper structure and the lower plate is mounted to the undercarriage, whereby changing the relative angular position of the upper plate relative to the lower plate changes the relative angular position of the upper structure relative to the undercarriage.

2. A work vehicle as defined by claim 1 wherein each hydraulic cylinder is provided with a pivot connection connecting the hydraulic cylinder to the upper plate.

3. A work vehicle as defined by claim 2 wherein the upper structure can be rotated about a vertical axis relative to the leveling assembly and undercarriage.

4. A work vehicle as defined by claim 3 wherein the two hydraulic cylinders are located on opposite side of the vertical axis and are canted outwardly from the vertical axis.

5. A leveling assembly for a work vehicle comprising an upper plate and a lower plate that are pivotally interconnected by a pivot assembly, the leveling assembly is also provided with two hydraulic cylinders operatively positioned between the plates for changing the relative angular position of the plates about the pivot axis, the two hydraulic cylinders ar each provided with a trunnion mounting assembly, the trunnion mounting assembly is mounted to the lower plate and a portion of each hydraulic cylinder extends outwardly from the lower plate, the upper plate is provided with a mounting assembly for securing the upper plate to an upper structure of a work vehicle and the lower plate is provided with a lower mounting assembly for mounting the lower plate to an undercarriage of a work vehicle.

6. A leveling assembly as defined by claim 3 wherein each hydraulic cylinder is provided with a pivot connection connecting the hydraulic cylinder to the upper plate.

7. A leveling assembly as defined by claim 6 wherein the two hydraulic cylinders lie on opposite sides of a vertical axis and the hydraulic cylinders are canted outwardly away from the vertical axis.

* * * * *